US005787500A

United States Patent [19]

Lobello

[11] Patent Number: 5,787,500

[45] Date of Patent: Aug. 4, 1998

[54] BODY HARNESS

[76] Inventor: Nicholas F. Lobello, 16755 W. 147th Pl., Lockport, Ill. 60441

[21] Appl. No.: 821,751

[22] Filed: Mar. 20, 1997

[51] Int. Cl.[6] ..... A41D 1/00; A62B 35/00

[52] U.S. Cl. ..... 2/1; 2/311; 182/3

[58] Field of Search ..... 2/1, 311, 312, 2/338, 94, 318, 69, 300, 302, 310, 319, 320; 182/3, 9, 137; 441/80, 106, 121; 224/157, 158; 27/28; 119/795, 799, 801, 856, 857, 863, 907; 5/611, 612, 621, 81.1 R; D30/153

[56] References Cited

U.S. PATENT DOCUMENTS

| | | | |
|---|---|---|---|
| 593,901 | 11/1897 | Murnan . | |
| 707,610 | 8/1902 | Moeller | 224/157 |
| 1,639,383 | 8/1927 | Moretti et al. . | |
| 1,796,775 | 3/1931 | Warren . | |
| 2,030,172 | 2/1936 | Kauffman | 2/1 |
| 2,564,564 | 8/1951 | Cookman . | |
| 3,089,143 | 5/1963 | Jacobson | 2/1 |
| 4,121,822 | 10/1978 | DiSabatino et al. . | |
| 4,530,309 | 7/1985 | Collins . | |
| 4,625,334 | 12/1986 | Proffer . | |
| 4,863,409 | 9/1989 | Johnson et al. | 441/80 |
| 4,944,043 | 7/1990 | Bush . | |
| 4,947,870 | 8/1990 | Larcher . | |
| 5,497,512 | 3/1996 | Wright | 2/1 X |
| 5,624,065 | 4/1997 | Steffe . | |

*Primary Examiner*—C. D. Crowder
*Assistant Examiner*—Shirra L. Jenkins
*Attorney, Agent, or Firm*—Ernest Kettelson

[57] ABSTRACT

A body harness for securing to and movement of a victim from harm's way, comprising an elongated belt for extending around the chest of a victim and under his armpits, having a quick lock-quick release buckle to rapidly buckle the ends of the belt together around the victim's chest and to rapidly unbuckle the ends for removal of the harness after the victim has been moved to a safe location so he can be quickly transported to a hospital for observation and treatment, and having an elongated hand grasp loop that is long enough to extend from its connection to the belt around the victim's chest in the direction toward the victim's head to a location beyond the victim's head where the rescuer can feel for, locate and grasp the hand grasp loop to drag the victim to safety. The hand grasp loop is attached to the belt at a diagonal so it extends diagonally in the direction toward the victim's head when the belt is secured around a victim lying on his back.

11 Claims, 4 Drawing Sheets

BODY HARNESS

FIELD OF THE INVENTION

This invention relates to the field of rescue straps or body harness devices for securing to a victim who needs to be removed from a dangerous location. The body harness in accordance with the present invention is particularly adapted for moving a victim out of the room of a building on fire which is filled with dark dense smoke.

BACKGROUND OF THE INVENTION

Prior art devices in this field known to the inventor include those disclosed in the following United States patents:

U.S. Pat. No. 5,514,019 discloses a life jacket in the form of a soft rubber vest with stabilizing handles projecting outwardly from opposite sides.

U.S. Pat. No. 5,361,418 discloses a girdle like device having a plurality of handles thereon for a person such as a training assistant to grasp, for example while teaching to swim.

U.S. Pat. No. 5,279,386 discloses a rescue harness comprising a closed loop which can be placed over the head and shoulders of a person, then cinched down around the person's back or chest, the device having a ring for connection to a safety line.

U.S. Pat. No. 5,152,013 discloses a stabilizing belt comprising a belt to extend around one person's waist, and a pair of handles extending from a rear portion of the belt for a person behind to grasp, such as the rear passenger on a motorcycle.

U.S. Pat. No. 5,081,719 discloses a motorcycle safety belt having handles for the person behind to grasp.

U.S. Pat. No. 5,065,773 discloses a weightlifter's belt having handles for a trainer to use while teaching a beginner the proper techniques for lifting.

U.S. Pat. No. 4,778,033 discloses a rescue device comprising two adjustable strap members each having a buckle, and a spring closure latch in one of the buckles to engage and connect to the other buckle.

U.S. Pat. No. 4,449,253 discloses a quick evacuation fireman's coat comprising a jacket and handles projecting from the jacket for rescuers to grasp.

U.S. Pat. No. 4,308,629 discloses a safety harness device comprising a wide chest band which is adjustable in length and lockable in any adjusted position, shoulder straps secured to the upper end of the chest band, leg straps secured to the lower end of the chest band, and a guide line has one end connected to the back of the chest band.

U.S. Pat. No. 3,564,616 discloses a waist belt for a motorcyclist, the waist belt having hand grips for a rider behind to grasp.

U.S. Pat. No. 2,956,541 discloses a shoulder and chest harness to be worn by a person learning to swim, and a strap or coil spring member is connected at one end to the training harness with its other end connected to a ring for the trainer to hold while teaching the trainee to swim.

SUMMARY OF THE INVENTION

The body harness in accordance with the present invention provides advantages and improvements over those known to the prior art. It comprises an elongated belt for extending around the chest of a victim found lying on the floor of a room filled with dark dense smoke or other hazardous material, rotating the victim on his back, bringing the ends of the belt to the front of the victim's chest and buckling the ends together at the front of his chest.

In a room filled with dark dense smoke or other hazardous material, it is necessary to drag the victim to safety keeping him close to the floor with the rescuer also keeping as close to the floor as possible. That is why the victim must be rotated to lie on his back, and that is why the belt is buckled at the front of the victim's chest.

The buckle in accordance with this invention has a quick lock and quick release lever to quickly lock the buckled ends together so the victim can be removed from the hazardous location as quickly as possible and to then quickly release the belt so the victim can be rapidly placed on a stretcher and transported to a hospital for observation and treatment.

An elongated hand grasp loop is secured to the belt at a location which is opposite from the buckled ends of the belt when buckled together at the front of the victim's chest. This means that the elongated hand grasp loop is attached to the belt under the victim's back when the belt is secured around the victim's chest. It would be difficult for the rescuer to feel around and find the hand grasp loop if the victim is lying on it. To eliminate such problem, the hand grasp loop is first of all elongated enough to extend from the belt around the victim's chest and under his armpits toward the victim's head and beyond a sufficient distance for the rescuer to grasp. In addition, the hand grasp loop is secured to the belt at a diagonal so when the belt is around the victim's chest and extending vertically, the hand grasp loop is extending diagonally in the direction toward the victim's head and beyond rather than downward in the same vertical direction as the belt around the prone victim's chest which would otherwise be the case. If the hand grasp loop was secured to the belt to extend in the same direction as the belt itself extends, it would not extend outwardly but would lie crumpled under the victim's back.

By securing the elongated hand grasp loop to the belt in a way that automatically extends the hand grasp loop diagonally from the belt in the direction toward the victim's head and beyond, the rescuer knows where to feel for and to readily find the hand grasp loop despite the lack of visibility due to the dark dense smoke. He can then grasp the hand grasp loop and drag the victim on his back to safety.

By locating the hand grasp loop's attachment to the belt so it lies under the victim's back when being dragged to safety, the pulling force exerted by the rescuer as he is dragging the victim tends to somewhat elevate the victim's head and shoulders as he is being dragged which makes it easier for the rescuer by lessening the frictional drag of the victim against the floor, and lessening the chance of any harm to the victim from being dragged.

Further advantages of the body harness in accordance with this invention will be apparent from the more detailed description which follows and from the accompanying drawings.

DESCRIPTION OF PREFERRED EMBODIMENT

Figure 1:
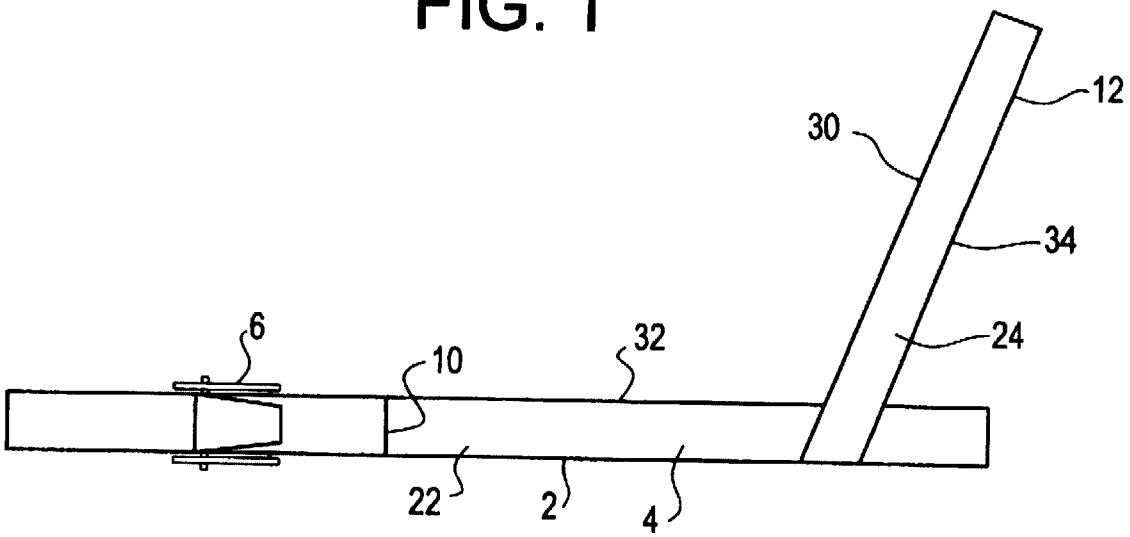
FIG. 1 is a side elevation view of a body harness in accordance with this invention shown with its opposite ends of its belt buckled together.
Figure 2:
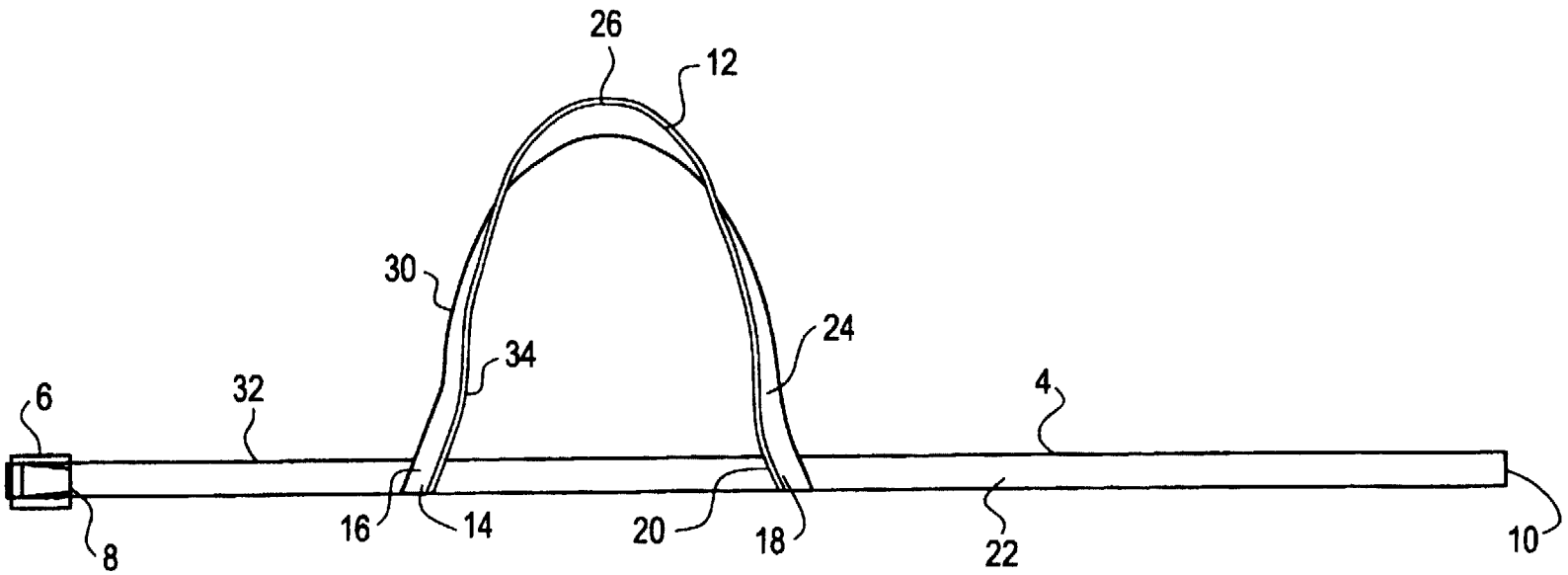
FIG. 2 is a side elevation view of a body harness in accordance with this invention shown with the belt ends unbuckled with the belt extending in a straight line from end to end.
Figure 3:
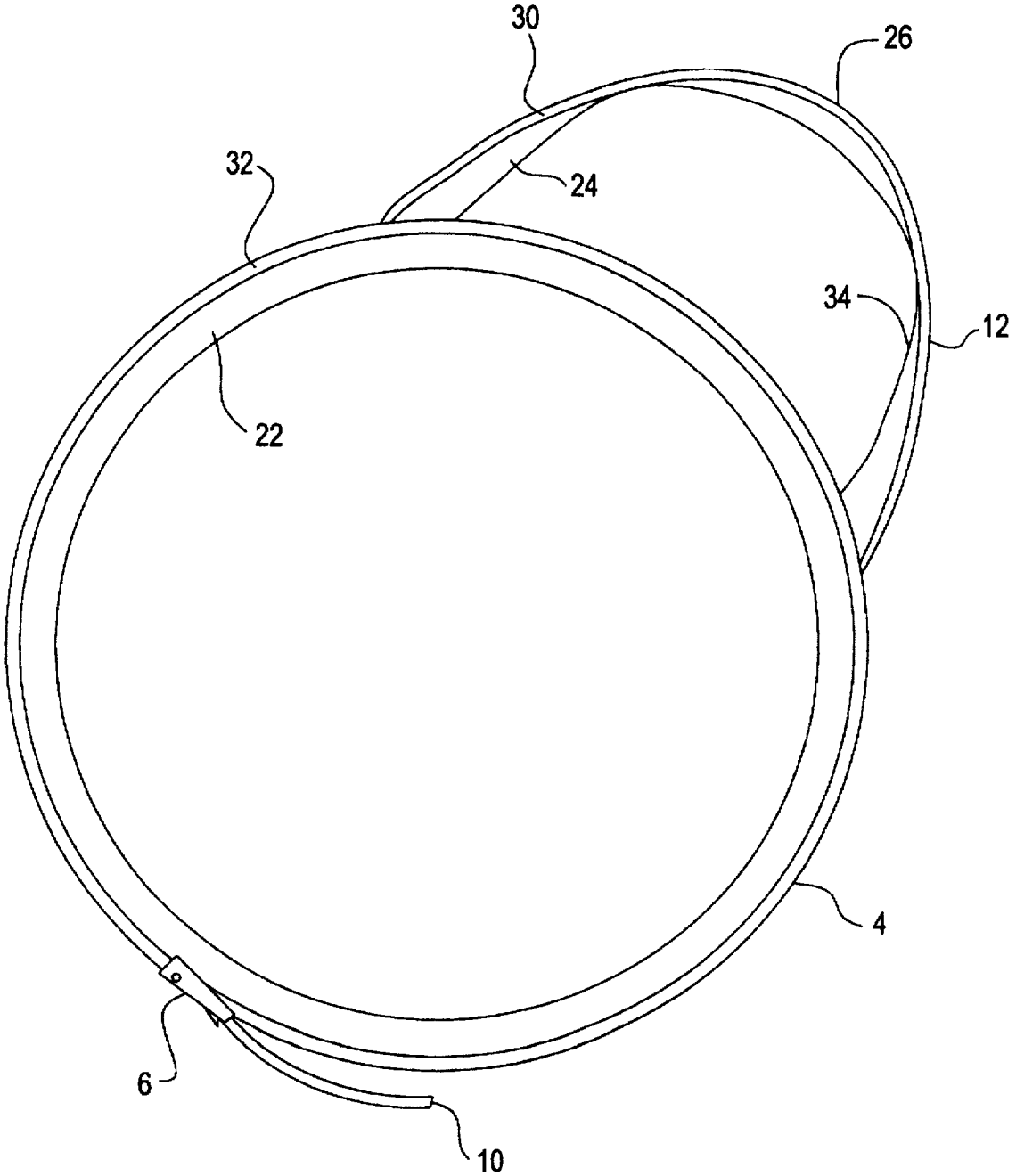
FIG. 3 is a perspective view from above of a body harness in accordance with this invention shown with the belt ends buckled together to form a belt loop and showing the hand grasp loop in a location opposite from the buckle connecting location.
Figure 4:
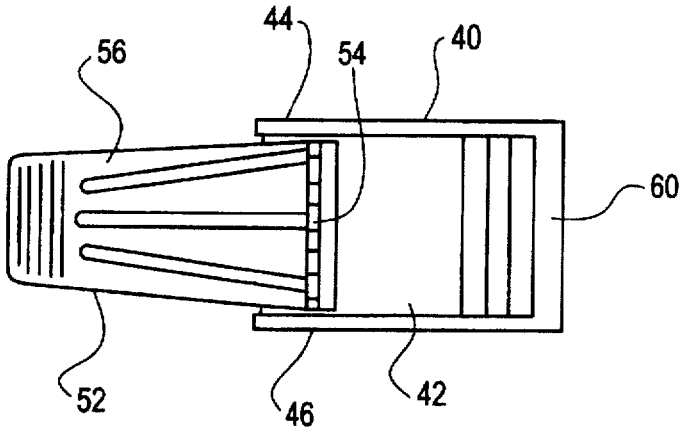
FIG. 4 is a top plan view of the buckle of the body harness in accordance with this invention shown with its operating lever in the release position.
Figure 5:
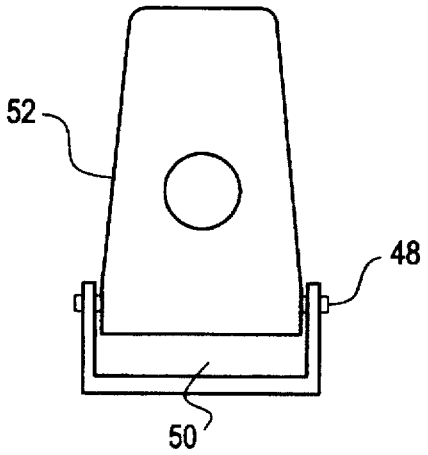
FIG. 5 is an end view of the buckle shown with its operating lever in the release position to view the belt receiving slot.
Figure 6:
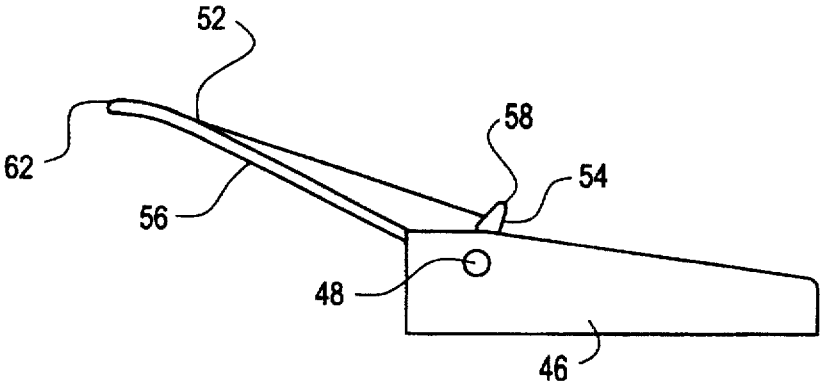
FIG. 6 is a side elevation view of the buckle shown with its operating lever in the release position.

A body harness 2 to rescue fire victims from a burning building comprises body loop means consisting of an elongated belt 4 of high strength flexible material comprising a belt panel long enough to extend around the chest of a victim, having a buckle 6 at a first belt end 8 to receive and hold the opposite second belt end 10 of the belt 4. Thus, the body loop means includes a buckle and only one additional member.

An enlarged hand grasp loop 12 including only one member, of the same high strength flexible material comprising a hand grasp loop panel is secured to the belt 4 of the harness 2, by sewing or otherwise securing loop end 14 to the belt 4 at location 16 and loop end 18 to the belt 4 at spaced apart location 20.

An appropriate high strength flexible material of which the belt 4 and loop 12 may be made is nylon webbing about two inches wide and about one-sixteenth to one-eighth inch thick. An appropriate length of the belt is about sixty inches to be able to extend around the chest region of a large individual with enough length left for reception of belt end 10 by the buckle 6.

The hand grasp loop 12 is secured to the belt 4 by positioning means in such a way that it extends at a diagonal to the side wall 22 of the belt 4. This positions the hand grasp loop outwardly from a victim when the belt 4 has been secured around his chest with the buckle 6 and buckled ends of the belt at the front of the victim's chest. Since the hand grasp loop 12 is secured to the belt 4 at a location opposite from the buckled ends 8 and 10, it would normally lie beneath the victim when he is lying face up ready to be dragged to safety making it difficult for the rescuer to locate quickly in a room filled with dense smoke. By securing the hand grasp loop 12 to the belt 4 at a diagonal to the belt side wall 22, the hand grasp loop 12 extends in the direction toward the head of the victim and beyond when the belt 4 is properly positioned and secured around the victim's chest.

To properly position the belt 4 around the chest of a victim, the hand grasp loop 12 should at such time extend diagonally from the belt 4 in the direction toward the head of the victim.

The hand grasp loop 12 is made of the same or similar high strength flexible material as the belt 4. Its side wall 24 is preferably the same width as the side wall 22 of the belt 4, namely about two inches. The width or thickness of the hand grasp loop material is also preferably about the same, namely about one-sixteenth to about one-eighth inch thick. The length of the hand grasp loop 12 is preferably about thirty inches, long enough for the apex 26 of the loop 12 to extend beyond the head of a victim for grasping when the belt 4 is secured around the victim's chest, under and adjacent to his armpits.

The hand grasp loop 12 is positioned and secured to the belt 4 at a location which places the apex 26 of the hand grasp loop in substantial longitudinal alignment with the buckle 6 when belt 4 extends around the chest of a victim and belt ends 8 and 10 are buckled.

In a belt 4 having a length of sixty inches and a hand grasp loop 12 of thirty inches as described herein, the location 16 at which loop end 14 is secured to the belt 4 is preferably about fifteen inches from the buckle end 8 of the belt 4. The location 20 at which loop end 18 of hand grasp loop 12 is secured to the belt 4 is preferably about twenty seven inches from the buckle end 8. When a body harness 2 having a belt 4 and hand grasp loop 12 of such dimensions and the hand grasp loop 12 secured to the belt 4 at such location, the apex 26 of the hand grasp loop 12 is in substantial longitudinal alignment with the buckle 6 when belt 4 extends around the chest of a victim with belt ends 8 and 10 buckled on the front side of such victim's chest, and with the hand grasp loop 12 facing diagonally from the opposite side of the belt 4 buckled around the victim's chest, extending in the direction toward and beyond the victim's head.

The hand grasp loop 12 is secured to the belt 4 as follows to make it extend diagonally from the belt 4. The hand grasp loop side wall 24 at loop end 14 is placed over the belt side wall 22 with the upper first hand grasp loop edge 30 of loop side wall 24 at an obtuse angle of about one hundred and ten degrees to the upper first belt edge 32 of the belt side wall 22, as well as to the opposite second belt edge and the lower second hand grasp loop edge 34 of the loop side wall 24 at an acute angle of about seventy degrees to the upper first belt edge 32 of belt side wall 22 as well as to the opposite belt edge.

Loop end 14 of the hand grasp loop is then sewn or otherwise secured to the belt 4 in such diagonally extending position.

The hand grasp loop side wall 24 at the opposite loop end 18 is placed over the belt side wall 22 in a similar diagonally extending position, wherein the upper edge 30 of loop side wall 24 is at an obtuse angle of about one hundred and ten degrees to the upper first belt edge 32 and opposite second belt edge of the belt side wall 22 and the lower edge 34 of loop side wall 24 is at an acute angle of about seventy degrees to the upper first belt edge 32 and opposite second belt edge of belt side wall 22.

Loop end 18 of the hand grasp loop is then sewn or otherwise secured to the belt 4 in such diagonally extending position.

The buckle 6 is a quick connect and release connector, comprising a buckle frame 40 having a base 42 fixedly connected to belt end 8, a pair of buckle side walls 44 and 46, a pivot pin 48 extending between buckle side walls 44 and 46 spaced apart from and above the buckle base 42 to provide a receiving slot 50 between the base and laterally extending pivot pin to receive the opposite end 10 of belt 4 therethrough.

A lock and release lever 52 is mounted on the pivot pin 48 pivotable between a release position wherein the receiving slot 50 is open to allow end 10 of belt 4 to pass inwardly and outwardly therethrough, and a locking portion wherein the laterally extending locking bar 54 of lock and release lever 52 is pivoted downwardly into tight gripping contact with the belt 4 which prevents it from being withdrawn from the buckle 6 until the locking bar 54 is manually pivoted to the release position.

The lock and release lever includes an elongated operating handle 56 which is integrally formed with the laterally extending locking bar 54 and extends substantially normal thereto. The locking bar 54 extends from the pivot end of the operating handle 56 in the direction toward which the belt end 10 is moved to enter into and through the receiving slot 50 of the buckle 6 when the lock and release lever 52 is in its release position. At such time, the operating handle 56 is in an upright position substantially normal or perpendicular to the buckle base 42 and the locking bar 54 extends substantially parallel to the base 42. When pivoted to the locking position, the operating handle 56 is substantially parallel to the buckle base 42 and the locking bar 54 is substantially normal to the base with its outer free end 58 in gripping and compressing engagement with the belt 4 received through the receiving slot 50. The locking bar 54 when in the locking position preferably extends in a slightly obtuse angle to that portion of the belt 4 which extends toward the free end 10 of the belt, whereby any pressure on the belt for movement outwardly from the buckle will cause the outer free end 58 of the locking bar to dig in more and compress even tighter against the belt.

When in the locking position, the operating handle 56 of the lock and release lever 52 rests against the rear cross bar portion 60 of the buckle 6, with the outer tip 62 of the operating handle 56 extending slightly beyond and curving slightly upward for ease of grasping to move to the release position.

The body harness in accordance with this invention is used as follows. When a rescuer enters a room filled with dense black smoke for example and finds a victim on the floor, the victim is rolled on to his back as the belt 4 is placed around his chest and under his armpits. The buckle end 8 and free end 10 of the belt are brought together on the front side of the victim's chest, free end 10 threaded through the receiving slot of the buckle and drawn up tight. The buckle's lock and release lever 52 is then moved to its locking position thereby securing the belt 4 around the victim's chest.

When the belt 4 is placed around the victim's chest, care must be taken to position it so the diagonally extending hand grasp loop 12 is extending in the direction from the victim's chest toward and beyond his head. Thus, when the belt is securely locked in place around the victim's chest, the hand grasp loop will be automatically positioned near and outwardly from the victim's head so the rescuing person can find it by feeling for it with his hand. In a room filled with dense dark smoke, it may not be possible to see where the hand grasp loop 12 is located so it is important that the body harness in accordance with this invention have the hand grasp loop connected to the belt at a diagonal which automatically extends the hand grasp loop to a known location near and just beyond the victim's head when the belt is strapped in place around his chest. The rescuer thus knows where to feel for and to find it. In rescue situations such as in a building on fire, time is of the essence so being able to rapidly locate the hand grasp loop with no loss of time is a significant advantage of this invention.

When the rescuer locates and grasps the hand grasp loop, the victim can then be dragged on his back, head first out of the smoke filled room to safety. The body harness 2 can then be quickly removed from the victim by unlocking the quick release buckle 6 as described, whereupon he can be quickly placed on a stretcher or in an ambulance for transport to a hospital.

I claim:

1. A body harness for securing to and movement of a victim out of harm's way, comprising body loop means to extend around the chest of a said victim, hand grasp means fixedly secured to said body loop means extending outwardly therefrom, and positioning means to extend and hold said hand grasp means outwardly at a diagonal to said body loop means, said body loop means including a buckle and only one additional member, said hand grasp means including only one member, said one additional member of said body loop means having a uniform thickness throughout and completely planar surface areas throughout, said one member of said hand grasp means having a uniform thickness throughout and completely planar surface areas throughout, said one member of said hand grasp means being the only member secured to and supported on said one additional member of said body loop means, said one member of said hand grasp means having a plurality of connections to said one additional member of said body loop means each of which fixedly secures said one member of said hand grasp means in position to extend continuously at a diagonal to said one additional member of said body loop means.

2. A body harness for securing to and movement of a victim out of harm's way as set forth in claim 1, wherein said one additional member of said body loop means includes an elongated belt forming a loop around the said chest of a said victim.

3. A body harness for securing to and movement of a victim out of harm's way as set forth in claim 1, wherein said one additional member of said body loop means includes an elongated belt having a first end portion and an opposite second end portion, belt connecting means comprising said buckle to connect said first and second end portions together to form a loop to extend around the said chest of a said victim, said first and second ends being connected together at a belt end connecting location of said loop, said one member of said hand grasp means being secured to said belt at a hand grasp location of said loop radially spaced apart from said belt end connecting location.

4. A body harness for securing to and movement of a victim out of harm's way as set forth in claim 3, wherein said hand grasp location of said loop is radially spaced apart from said belt connecting location a distance which places said hand grasp location substantially opposite from said belt end connecting location.

5. A body harness for securing to and movement of a victim out of harm's way as set forth in claim 1, wherein said one member of said hand grasp means includes a hand grasp loop having a first hand grasp loop end secured to said one additional member of said body loop means at a first hand grasp loop end location and a second hand grasp loop end secured to said one additional member of said body loop means at a second hand grasp loop end location spaced apart from said first hand grasp loop end location, said first and second hand grasp loop ends being comprised of said plurality of connections of said one member of said hand grasp means to said one additional member of said body loop means.

6. A body harness for securing to and movement of a victim out of harm's way as set forth in claim 5, wherein said one additional member of said body loop means includes a flexible belt having a belt panel extending from a first belt end to a second belt end, said belt panel having a first belt edge extending along one side edge and a spaced apart second belt edge extending along its opposite side edge, said hand grasp loop comprises a flexible hand grasp loop panel extending from its said first hand grasp loop end to its said second hand grasp loop end, a first hand grasp loop edge along one side edge of said hand grasp loop panel and a second hand grasp loop edge along the opposite side edge thereof, said positioning means comprises said plurality of connections securing said hand grasp loop ends to said belt in a position wherein said first hand grasp loop edges of said first and second hand grasp loop ends of said hand grasp loop panel extend at an obtuse angle to said first belt edge of said belt panel, and said second hand grasp loop edges of said first and second hand grasp loop ends extend at an acute angle to said first belt edge of said belt panel whereby said hand grasp loop is positioned to extend at a diagonal from said belt.

7. A body harness for securing to and movement of a victim out of harm's way as set forth in claim 6, including a buckle on said first belt end for connecting said second belt end thereto at a buckle connecting location of said belt, said hand grasp loop panel being connected to said belt at a location which is substantially opposite from said buckle connecting location of said belt when said second belt end is connected to said first belt end by said buckle.

8. A body harness for securing to and movement of a victim out of harm's way as set forth in claim 7, wherein said belt has sufficient length to extend around a victim's chest for buckling said second belt end to said first belt end in front of a victim's chest when lying face up on a supporting surface, said hand grasp loop panel connected to the substantially opposite side of said belt being under a said victim lying face up with said belt ends buckled in front of said victim's chest, said hand grasp loop panel having a length sufficient to extend far enough from said belt in the direction toward said victim's head to reach outwardly beyond said victim's head.

9. A body harness for securing to and movement of a victim out of harm's way as set forth in claim 7, wherein said buckle includes a quick lock and release mechanism to quickly buckle and lock said belt ends together when said belt is extended around the body of a said victim and to quickly release said belt ends for quick removal of said body harness from a said victim after he has been moved out of harm's way.

10. A body harness for securing to and movement of a victim out of harm's way as set forth in claim 9, wherein said quick lock and release mechanism of said buckle includes a buckle frame secured to said first belt end, said buckle frame having a receiving slot to receive said second belt end therethrough, a lock and release lever pivotally mounted over said receiving slot having a contact member for compressing and retaining engagement with said belt received in said receiving slot when said lock and release lever is pivoted to its belt retaining position and for release of said belt when said lock and release is pivoted to its release position.

11. A method of providing and securing a body harness to a victim and movement of said victim out of harm's way, comprising the steps of obtaining a strap member comprising a buckle and only one other member of sufficient length to extend around the chest of a victim lying horizontally on a surface face up said buckle to connect being provided opposite ends of said strap member together at a buckle location thereof in front of the chest of said victim, said strap member having uniform thickness throughout and completely planar surface areas throughout securing an elongated hand grasp loop member having two opposite ends to said strap member by fixedly securing both of said two opposite ends to said strap member at a diagonal at a location diametrically opposite from the location of said buckled portion of said strap member and to extend diagonally in a direction away from said buckled portion, said hand grasp loop member including only one member, said one member of said hand grasp loop member having a uniform thickness throughout and completely planar surface areas throughout, said one member of said hand grasp loop member being the only member secured to and supported on said one additional member of said strap member extending said strap member around the chest of said victim to buckle in front of said victim's chest and with said elongated hand grasp loop member extending outwardly beyond the shoulders and head of said victim for ready access thereto by a rescuer to drag the victim to safety when said strap member has been buckled, buckling said strap member in front of the chest of said victim lying on a horizontal surface face up, grasping said hand grasp loop member and dragging said victim out of harm's way.

* * * * *